United States Patent [19]

Danos

[11] Patent Number: 5,029,195

[45] Date of Patent: Jul. 2, 1991

[54] APPARATUS AND METHODS OF PRODUCING AN OPTIMAL HIGH INTENSITY X-RAY BEAM

[76] Inventor: Michael Danos, 4820 Hutchins Pl., Washington, D.C. 20007

[21] Appl. No.: 391,698

[22] Filed: Aug. 7, 1989

Related U.S. Application Data

[63] Continuation-in-part of Ser. No. 765,183, Aug. 13, 1985, abandoned, which is a continuation of Ser. No. 487,427, Apr. 23, 1983, abandoned.

[51] Int. Cl.[5] ..... H01J 35/30

[52] U.S. Cl. ..... 378/121; 378/137; 378/138

[58] Field of Search ..... 378/119, 137, 138, 140, 378/147

[56] References Cited

U.S. PATENT DOCUMENTS

| | | | |
|---|---|---|---|
| 805,795 | 11/1905 | Heinze | 378/147 |
| 1,865,441 | 7/1932 | Mutscheller | 378/85 |
| 2,075,146 | 3/1937 | Sergeeff | 378/123 |
| 2,497,543 | 2/1950 | Frevel | 378/85 |
| 2,497,755 | 2/1950 | Berggren | 378/150 |
| 3,376,415 | 4/1968 | Krogstad et al. | 378/49 |
| 3,751,701 | 8/1973 | Gralenski et al. | 378/138 |
| 4,012,656 | 3/1977 | Norman et al. | 378/122 |
| 4,145,616 | 3/1979 | Tanabe | 378/150 |
| 4,158,142 | 6/1979 | Haimson | 378/10 |
| 4,166,231 | 8/1979 | Braun | 378/125 |
| 4,200,803 | 4/1980 | Becker et al. | 378/148 |
| 4,203,036 | 5/1980 | Tschunt | 378/9 |
| 4,229,657 | 10/1980 | Bensussen | 378/125 |
| 4,321,471 | 3/1982 | Holland et al. . | |
| 4,392,235 | 7/1983 | Houston . | |
| 4,566,116 | 1/1986 | Nakono et al. | 378/121 |
| 4,718,075 | 1/1988 | Horn | 378/137 |
| 4,748,650 | 5/1988 | Ammann | 378/137 |

OTHER PUBLICATIONS

"Tables of Energy Losses and Ranges of Electrons and Positrons", Berger, NASA, p. 80, 1964.

*X-Ray Spectroscopy,* Leonid Azaroff, McGraw Hill, pp. 156–162, 1974.

"Photon Cross Sections, Attenuation Coefficients and Energy Absorption Coefficients from 10 keV to 100 GeV", Hubbell U.S. Dept. of Commerce, National Bureau of Standards, Table 3, Aug. 1969.

*Small-Angle X-Ray Scattering,* Brumberger, Gordon & Breach Scientific Publishers, pp. 64–79, 1967.

"Electron Energy and Charge Albedos—Calorimet Measurment v. Monte Carlo Theory", Lockwood, U.S. Dept. of Energy, pp. 56, 57, 68, Nov. 1981.

*Radiology of the Skull and Brain: Technical Aspects of Computed Technology,* Newton (ed.), C. V. Mosby Co., pp. 4058–4095, 1981.

*Primary Examiner*—Craig E. Church

*Attorney, Agent, or Firm*—Howard L. Rose

[57] ABSTRACT

Apparatus and method for deriving an x-ray beam from an electron beam striking an anode at a selected angle, the x-ray beam being selectively directed to achieve optimal high intensity yield of high energy bremsstrahlung photons for a given x-ray beam cross-section. The angle of the x-ray beam relative to the anode is selected (1) to prevent anode damage and (2) to minimize undesired multiple scatter, and (3) maximize high energy photon production in the bremsstrahlung spectrum. The angles of the incident electron beam and of the emitted x-ray beam and the angle of the planes normal to the anode surface and containing the electron beam and x-ray beam, respectively, are defined to account for multiple scattering and out-scattering of electrons as well as enhanced x-ray beam intensity, and angular distribution of emitted photons of a desired energy.

14 Claims, 4 Drawing Sheets

APPARATUS AND METHODS OF PRODUCING AN OPTIMAL HIGH INTENSITY X-RAY BEAM

RELATED APPLICATIONS

This is a Continuation-in-part to application Ser. No. 765,183 filed Aug. 13, 1985 now abandoned which is a continuation of application Ser. No. 487,427 filed Apr. 23, 1983 now abandoned.

TECHNOLOGICAL CONTEXT OF THE INVENTION

In the past, various methods of generating photons by electron excitation have been suggested. One prior device is a spectrometer which employs a tungsten filament placed close to the face of a specimen which is periodically rotated. Electrons are directed normal to the surface of the specimen with x-rays being emitted at an acute angle relative to the surface. This spectrometer has been found objectionable because the oblique path length of the generated x-rays is "unduly long and results in considerable self-absorption." (See *X-Ray Spectroscopy* by Leonid Azaroff, 1974, pp. 157–158).

More recent spectrometer have included the directing of a focused electron beam obliquely toward a specimen surface, with the radiation being detected in a direction normal to the surface. This design (according to Azaroff) minimizes self-absorption and has been considered preferable.

Based on the observations of Azaroff, one would conclude that the optimal positioning of the exiting photons of the generated x-ray beam is perpendicular to the anode surface. However, even these observations would underscore the fact that only a very small fraction of the electron beam power is converted into high energy x-ray photons while the remaining power converts to heat. It is this heat generation and loading that effectively limits the anode's capacity for generating x-ray power. Furthermore, in practice, it is the high energy bremsstrahlung x-rays that are desired for tomographic imaging, etc. Thus, it is desired to maximize the proportion of those x-rays related to the output.

This invention seeks to optimize characteristics of deflection and multiple scattering behavior of electrons in a target anode to decrease heat power loading in relation to high energy portion of x-ray generation. Electrons upon entry into the anode loose energy and scatter from the original directional vector. Scatter continues until the electrons either have lost all kinetic energy or escape the anode. The electrons have been observed to lose 1 MeV per centimeter of anode thickness at 100 keV of beam energy. Four factors govern the characteristics of the generated x-ray beam. They are intensity, height, width and beam divergence. In a pencil beam device, the last three are determined by a collimator while the first is governed by the electron beam power anode and anode impingement/emission characteristics.

The present invention contemplates employing the anode impingement/emission characteristics to optimize high energy x-ray production with both a sweeping and nonsweeping pencil beam as well as a flat (curtain) beam or broad beam apparatus. In the context of a pencil beam, the invention first contemplates that the angle $\beta$ of the x-ray beam relative to the anode surface is preferably small (between 1° and 5°). Secondly, calling the angle between the direction of the electron beam and the anode plane $\alpha$, establish a glancing angle $\gamma$ between the planes lying normal to the anode surface and containing the x-ray and electron beams, respectively the angle $\alpha$ in this configuration lying between 1° to below 5° relative to the anode.

The relationship of the $\alpha$ angle (electron beam) and $\beta$ angle (x-ray emission beam) establishes that as the angle $\beta$ decreases, the distance a photon must travel in order to pass through the anode increases. However, the present invention recognizes that the path length of an electron is much shorter than the distance at which a photon is likely to be absorbed. That is, the invention realizes that the ratio $\sin \alpha / \sin \beta$ can be as large as 20, 50, or even 100 before any significant x-ray absorption takes place. However, as the angle changes, the distance the photon must travel before leaving the anode does not change.

The present apparatus and method avoid overheating and damaging an anode resulting from the application of too great a power density thereto. To avoid this critical problem, the invention recognizes that a smaller $\beta$ angle results in a larger target area and, hence, a lower power density on the anode for an incident electron beam of a given intensity. The smaller the $\beta$ angle, for an x-ray beam of a given cross-sectional area, the more concentrated, i.e. the higher the intensity of the selected portion of the x-ray beam for a fixed power density applied to the anode.

Thus, it is an object of the invention to provide an x-ray beam of high intensity where the problem of overheating the anode is greatly alleviated. In addition to recognizing the significance of a small $\beta$ which results in a larger target area one recognizes that a small angle $\alpha$ causes out-scattering from the anode of low energy electrons and results in reduced anode heating. Hence, the invention contemplates a lower power density on the anode for an incident electron beam of a given intensity to establish an exiting x-ray beam of a desired cross-sectional area.

The invention also accounts for other significant factors which affect the generated x-ray beam. The above-mentioned photon absorption factor is such a consideration. That is, with $\beta$ defined small enough to substantially avoid overheating and to maintain high intensity, $\beta$ may be further limited to be large enough to avoid absorption. Similarly, the small $\beta$ which avoids overheating may be limited in addition by a maximum size of the anode or tube. That is, where $\beta$ at least in part determines the distance along the anode between the entering electron beam and the exiting x-ray beam, an angle for $\beta$ (and $\alpha$) may be selected large enough to reduce the anode and tube size while still being small enough to avoid overheating and to maintain high intensity.

A further consideration pertains to angular distribution. This consideration relates to the angle denoted henceforth by 180° $-\Theta$ relative to the forward electron beam at which photons of desired energy are most likely to be emitted. An angle of just above 90° between the incident electron beam and the exiting x-ray beam provides a high probability of emission; however, the sensitivity between 60° and 120° is generally slight and the primary factors pertaining to a small $\beta$, as noted above, greatly outweigh this characteristic. This desired angle can be achieved by choosing the angle $\gamma$ appropriately. The relation between all these angles from spherical trigonometry is known to be $\cos \Theta = \sin \alpha \sin \beta + \cos \alpha \cos \gamma$. Hence, one aspect of angular distribution is considered in determining both the angle of the incident electron beam and the angle of the exiting x-ray beam, subject to effects resulting from a small $\beta$. A limiting minimal value for the angle $\alpha$ of the incident electron beam relative to the anode surface for a given electron beam intensity may be imposed.

A third consideration relates to multiple scattering and deflection of electrons. As with the angular distribution factor, multiple scattering limits how small the angle $\alpha$ can be.

The contribution to enhanced x-ray beam generation efficiency by varying the angle of $\beta$ relative to the anode surface should be clear. However, the enhanced beam intensity can be further compounded by employing an angle $\alpha$ of less than 10°. If the angle of $\alpha$ is close to 0°, a substantially larger fraction of lower energy electrons are deflected or repelled by multiple scattering from the anode thus avoiding low-energy x-ray generation. Since the low energy electrons do not produce high energy photons, the resulting photon energies either would be insufficient to escape the anode or inadequate for high energy x-ray production. Thus, for the purposes of this invention, the low energy electrons only contribute to undesirable heating of the anode.

In accordance with the invention, it is recognized that for an x-ray beam of given cross-section (flat or pencil), offsetting the plane of the anode surface relative to the x-ray beam or electron beam increases the x-ray intensity by decreasing $\alpha$. This phenomena is primarily due to electron scattering characteristics where lower energy electrons are scattered out from the anode. The immediate salutary effect is to minimize heating of the anode. As $\alpha$ decreases, the distance a photon must travel to leave the anode also decreases resulting in less probability of absorption. Competing with the benefits of decreased absorption, however, are corresponding factors of the increased electron scattering and the angular distribution effects. Namely, for very small $\alpha$, a larger fraction of high energy electrons will be scattered out of the anode. Minimizing the high energy electrons also minimizes the potential for generating high energy photons. Furthermore, by configuring the entry/exit planes in a third dimension (angle $\gamma$), the x-ray selection is optimized and anode heating minimized. These effects are considered in providing optimal conditions for generating an optimal x-ray beam.

Similarly, where an x-ray beam of given intensity is desired, the invention provides a technique for generating such a beam with a lower power density electron beam.

An optimal, high intensity x-ray beam according to the invention finds particular significance and utility when employed in a pencil beam type radiation scanning apparatus such as that set forth in U.S. Pat. No. 4,229,651, which for that purpose, is incorporated herein by reference. Specifically, this invention is significant in such a CT scanner environment where it is desirable to provide with a flat beam, as much x-ray power (x-ray energy over as short a time) as possible for a scanner having a given geometry. With the present invention, CT procedures can be reduced in time since the x-ray power for a given anode is increased because heating by the electron beam input is greatly decreased (recall x-ray power=x-ray photon energy x number of x-ray photons per second).

Likewise, this invention amplifies on the teaching of Houston, U.S. Pat. No. 4,392,235, describing an x-ray source for CT applications incorporating a structure maintaining the electron beam impinging on the x-ray producing anode at an angle of 6°-13°. The Houston device results in enlarging the x-ray focal spot into a rectangular configuration having a cross-sectional length five to ten times the width which is then bent to provide a circular cross-section. The teachings of the instant invention enhance the performance characteristics of apparatus such as that disclosed in Houston.

Given the following descriptions of the drawings, the instant invention should be evident to the person having ordinary skill in the art.

DESCRIPTION OF THE INVENTION

Figure 1:
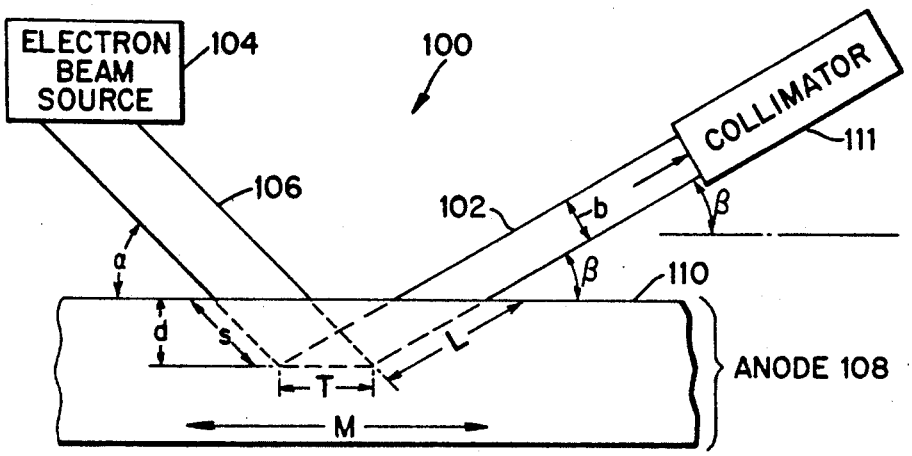
FIG. 1 is a front-view illustration of an x-ray beam being derived from an electron beam striking an anode in accordance with the invention, for the case when $\gamma=180°$.

Referring to FIG. 1, apparatus 100 for producing an x-ray beam 102 is shown. An electron beam source 104 directs a beam of electrons 106 toward an anode 108 at an angle $\alpha$. As is known in the art, the electrons enter the anode 108 to generate bremsstrahlung photons. The distance an electron travels before generating bremsstrahlung photons is a function of anode material, electron beam energy, and photon wavelength. With these factors constant, the probable distance of electron penetration is a distance s measured from the surface 110 of the anode 108.

The various electrons in the beam 106 generally travel a distance s beyond which x-rays of a desired energy are not produced. The distance s defines a target area parallel to and at a depth d from the anode surface 110. The length of the target area is shown in FIG. 1 as T.

Figure 2:
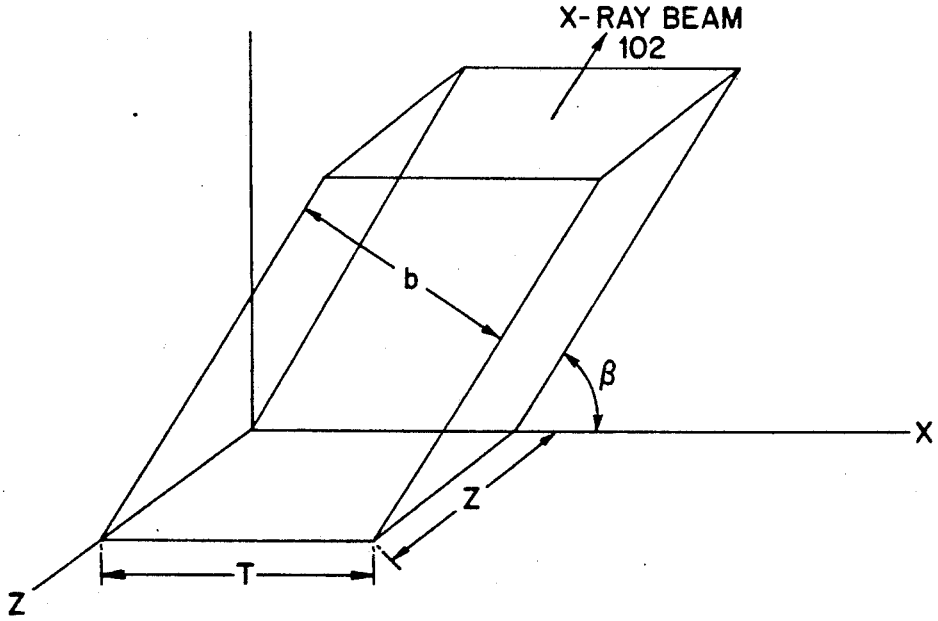
FIG. 2 is an upper right perspective view (in an XYZ coordinate system) of the exiting x-ray beam.

Exiting the target area are photons. In accordance with the invention, photons exiting the target area at an angle $\beta$ provide an x-ray beam 102 of predefined cross-sectional area, e.g. height and width, that can be directed through, and is determined by, collimator 111. Specifically, as seen in FIG. 2, the target area ($A_T$) is shown having the length T and the width z. A substantially rectangular x-ray beam 102 is shown having a width b, the depth of the beam 102 being z. The size of the x-ray beam 102 may be determined by the environment. Also, the intensity of the x-ray beam 102 may be environment dependent. In environments such as CT scanners employed in tomography and the like, a fan beam of small height and of high intensity is generally desirable.

Figure 3:
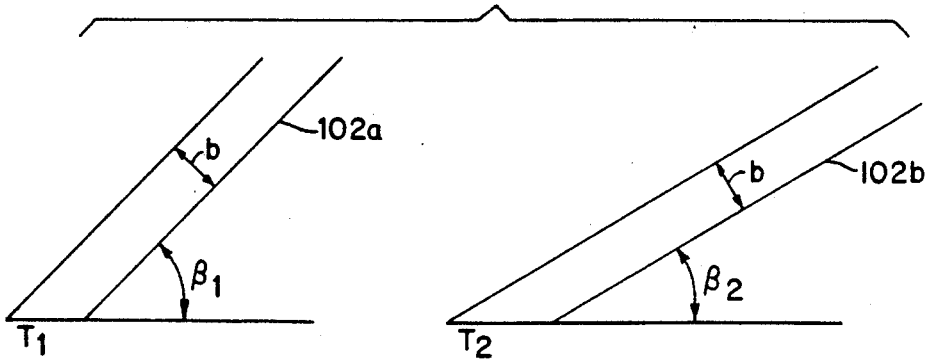
FIG. 3 is an illustration showing photons from a larger target area contributing to the x-ray beam as angle $\beta$ decreases.

Referring to FIG. 3, two different conditions of a pencil beam are shown. The first shows an x-ray beam 102*a* of height b exiting the target area at an angle $\beta_1$. The second shows an x-ray beam 102*b* also of height b exiting the target area at a smaller angle $\beta_2$. Where the width of the x-ray beams 102*a* and 102*b* is z, it is noted that the cross-sectional areas of the beams 102*a* and 102*b* are the same. The present invention recognizes that the target areas from which the x-ray beams 102*a* and 102*b* emerge vary in size in part based on the angle $\beta$. Specifically, the cross-section of x-ray beam represented by the beam height b, the length T of the target area (the width z being unchanged), and the angle are related according to the expression:

$$\sin\beta = \frac{b}{T} \tag{1}$$

Accordingly, as shown in FIG. 3, decreasing $\beta$ from $\beta_1$ to $\beta_2$ results in an increase in T, from $T_1$to $T_2$.

The increased target area (as shown in FIG. 2 as T multiplied by z) becomes a particularly significant consideration when it is realized that the anode 108 suffers damage if exposed to a power density greater than a prescribed maximum $D_{max}$. For example, a tungsten anode melts when the power density exceeds a level $D_{max}$ (approximately 10 kW/cm$^2$). To avoid overheating, the invention teaches that a large target area is to be used so that power is not concentrated on a small area of the anode. In achieving this, the invention recognizes that power density is proportional to sin $\beta$ and therefore provides a small value for $\beta$. Specifically, for an x-ray beam of area A and an electron beam of power $P_e$, the angle $\beta$ (which is inversely related to the target area $A_T$) is limited by the expression:

$$\sin\beta \leqq \frac{AD_{max}}{P_e} \tag{2}$$

Generally, $D_{max}$ and $P_e$ are predefined by the structure of the electron source 104 and the anode 108. Hence, according to expression (2), the area A or the angle $\beta$ may be altered by appropriately varying the other. The electron beam power $P_e$ is related to the x-ray beam power $P_x$ by an efficiency factor eta ($\eta$) which denotes the number of photons generated per electron for a given anode and structure. Hence defining $P_x$ or $P_e$ sets the other, factors such as angular distribution of emission remaining unchanged.

In accordance with the invention, the angle $\beta$ is made small to increase beam intensity for a given anode that overheats when exposed to a prescribed power density of an excessive level.

Referring again to FIG. 1, it is observed that photons in an exiting x-ray beam 102 generally travel a distance L before emerging from the anode surface 110. At a certain distance for L, namely $L_A$, a substantial amount of x-ray absorption occurs. As the distance L increases beyond $L_A$, increasing absorption results. For example, at distance $L_A$, 20% of the photons may be absorbed with the percentage increasing as the distance increases. It is, however, noted that the penetration distance s of the electrons is considerably smaller than the distance $L_A$. In fact, absorption generally does not become serious until the angles of $\alpha$ and $\beta$—which determine the distances s and L—are so related that sin $\alpha$/sin $\beta$ exceeds 20, or as much as 100 in some cases. In other words, $\beta$ should be less than 5° (1°–5°) and, preferably, in a general context about 3°. Accordingly, a small $\beta$ is still permitted although this secondary consideration may add another imposable limit.

That is, the invention contemplates the following limitation, subject to the condition of expression (2):

$$\sin\beta \leqq \frac{d}{L_A} \tag{3}$$

Figure 4:
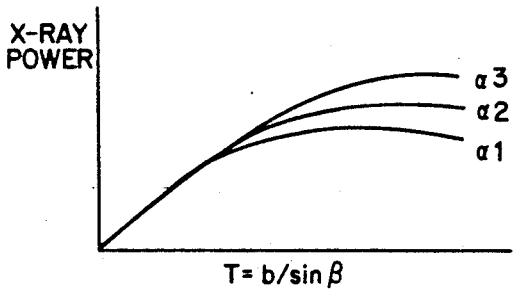
FIG. 4 is a general graph illustrating the change in x-ray power as a function of the angles $\alpha$ and $\beta$, for $\gamma=180°$.

In addition to photon absorption, the device 100 provides for setting the angles of $\alpha$ and $\beta$—subject to expression (2)—to account for angular distribution and the multiple scattering of electrons. FIG. 4, shows first that, for a given b and a given photon energy, with increasing T—i.e. decreasing $\beta$—the x-ray beam power $P_x$ relative to electron beam power $P_e$ after, first, increasing from the initial value at $\beta$=90° (indicated in FIG. 4 by the origin of the graph) up to a maximum value, decreases when the electron beam 102 strikes the anode at a given incident angle $\alpha_1$ (or $\alpha_2$ or $\alpha_3$) Moreover, for a given T, when normalizing the ratio $P_x/P_e$ to lie on the origin of the graph, the ratio of $P_x/P_e$ decreases with increasing $\alpha$, $\alpha_1$ being greater than $\alpha_2$ and $\alpha_2$ being greater than $\alpha_3$.

In any system the use to which a piece of equipment is to be put determines its final design. Thus in effect a system is designed by working backwards. In x-ray apparatus the factors which determine the specific design are: beam intensity and beam size (that is, width and height), beam divergence and the spectrum of photon intensities in the beam. The beam width, z, height, b, and divergence are as in all x-ray apparatus of the type described herein determined by the collimator, collimator 111 in FIG. 1.

As is well known, the maximum energy of photons in the x-ray beam is determined by the maximum energy of the exciting electron beam, the two maximum energies being equal. The x-ray intensity determines, in a well-known manner, the required electron beam intensity. The electron beam power then determines the minimum area of impact of the beam where the area is equal to z×T of FIG. 1. The length T of the target area is determined by the maximum power per square centimeter that the electron beam target can absorb without overheating; the factor z being determined, as indicated above, by the ultimate use of the device via the collimator. The angle $\beta$ is then determined by sin $\beta$=b/T; see Equation 1 above and T is a function of Equation 2 above for power density.

The energy spectrum of photons is a function of the length L, that the photons must traverse before exiting the anode 110. Obviously, the lower energy photons will be absorbed over a shorter distance than the higher energy photons and thus the spectrum of photon energies can be selected by appropriately choosing length L. As indicated by Equation 3, the maximum usable depth of the target area, d, is a function of sin $\beta$ and the dimension L. The length s depends on the target material and is associated with the stopping power of the material of the anode. The angle $\alpha$ is related to the length s; sin $\alpha \leqq$ d/s (see FIG. 1). However, the consideration of out-scattering of the low-energy electrons, referred to above, usually indicates to smaller angles $\alpha$ than that given by the above equation.

Thus all parameters of the device are determined by end user specifications and standard physical characteristics of the materials employed.

Figure 5:
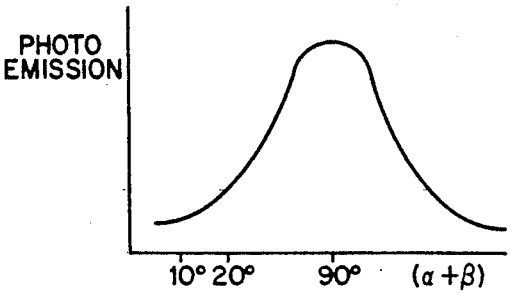
FIG. 5 is a general graph illustrating the photon emission probability as a function of $\alpha+\beta$ when $\gamma=180°$.

Angle $\beta$ can be limited by (a) multiple scattering as electrons enter the anode at angles closer to zero and (b) the angular distribution illustrated in FIG. 5. In FIG. 5, the probability of photon emission is depicted as being relatively insensitive when $\Theta$ approximates 90°. However, as $\Theta$ approaches 20°, or 10° in some cases, the emission probability becomes a significant secondary factor.

Still another consideration refers to the overall size, or length, of the anode 108 (of FIG. 1) and the tube (not shown) housing the anode 108. As the angle $\beta$ decreases, the required length M of the anode 108 increases. Again, subject to equation (2) and to the various secondary concerns identified above, the angles $\alpha$ and $\beta$ may be limited to achieve a desired overall anode length M.

Figure 6:
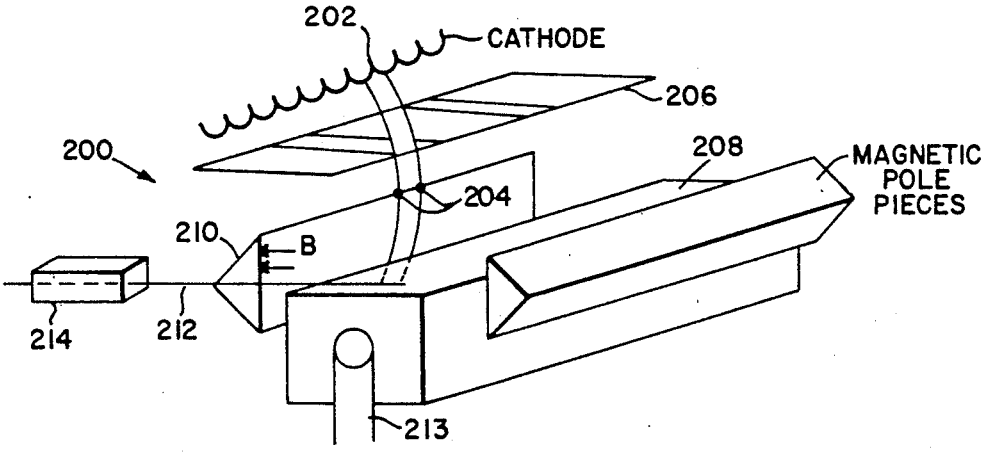
FIG. 6 is an illustration of an embodiment of the invention.

FIG. 6 shows apparatus 200 for achieving the effects of the invention relating to angles $\alpha$ and $\beta$. Specifically, a cathode 202 directs electrons 204 through beam-focusing plates 206 toward an anode 208. En route to the anode 208, the electrons 204 are deflected by magnetic pole pieces 210 which apply a magnetic field B to the traveling electrons 204. The electrons 204 are thereby directed to penetrate the anode 208 at an angle $\alpha$ (see FIG. 1). The electrons 204 travel an effective distance s into the anode 208. A beam of x-rays 212 is emitted from the anode 208 at a small $\beta$ angle, as discussed with reference to FIG. 1 and 2. The area of the anode 208 onto which the beam of electrons strike and from which photons emerge is extremely large. The anode 208, which is heated by the electrons 204, is cooled through tube 213.

Figure 7:
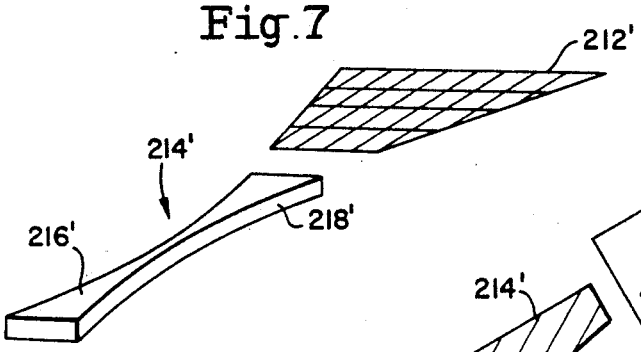
FIGS. 7 and 8 are perspective and top views of a collimator for directing an x-ray beam exiting from an anode.
Figure 8:
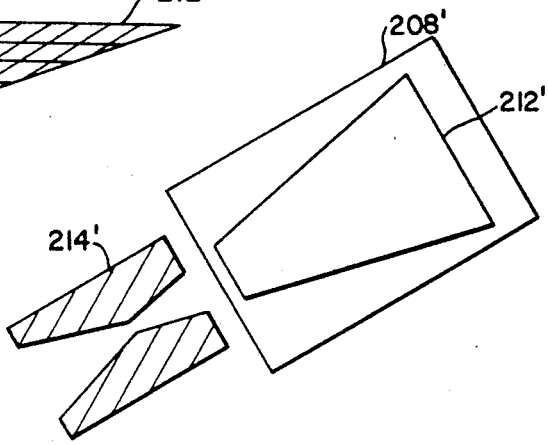

The emitted photon beam 212 is directed toward a collimator 214. As an alternative embodiment, FIG. 7 and 8 illustrate a collimator 214' which forms beam 212' from anode 208' into a fan-shaped beam. The shape illustrated as 216' in FIG. 7 is that of the opening in the collimator, while in FIG. 8, the material of the collimator is depicted by crosshatched area 214'.

Now turning to the angle $\gamma$ in the context of a pencil beam, it embraces the relationship of the geometries of the impinging electron beam, anode, and emitted x-ray beam in positioning of the collimator relative to the anode and impinging electron beam. Angle $\gamma$ is selected subject to angles $\alpha$ and $\beta$, to maximize the emission probability of the photons having the desired energy which probability is determined by angle $\Theta$, described below. The position of the collimator is to optimize the selection of the emitted x-rays having energies in a defined range. That preferred energy range generally falls within the high energy bremsstrahlung spectrum.

As noted above, the electron beam produces an indiscriminate beam of x-rays having many different energies. The intensity of the x-rays of any one particular energy range in the spectrum will be maximized along certain vectors relative to the anode. Accordingly, this invention seeks to maximize collimation and utilization of selected emitted high energy x-rays by locating the collimator in an appropriate position. The preferred geometric relationship of the collimator relative to the plane of the anode surface to achieve selection of high energy x-rays has been found to be at an angle of approximately less than 10°. Simple geometry dictates, however, that since $\beta$ relates to the collimator (selected x-ray beam vector) and $\gamma$ to the angle between the plane of x-ray beam and the plane of the impinging beam relative to the anode surface, selecting an angle affects the arc of angle $\Theta$ relative to the source and collimator (which also, in part, depends on the angles $\alpha$ and $\beta$). The relationship of $\beta$ to $\gamma$ is definable by a spherical geometric calculation.

Angle $\Theta$ is the angle measured with respect to the electron beam and the photon emission direction. Since angle $\Theta$ determines the probability of the photon distribution of photons having a particular energy, control of the system is achieved by first selecting angles $\alpha$ and $\beta$ and, secondly, selecting angle $\gamma$.

Figure 9:
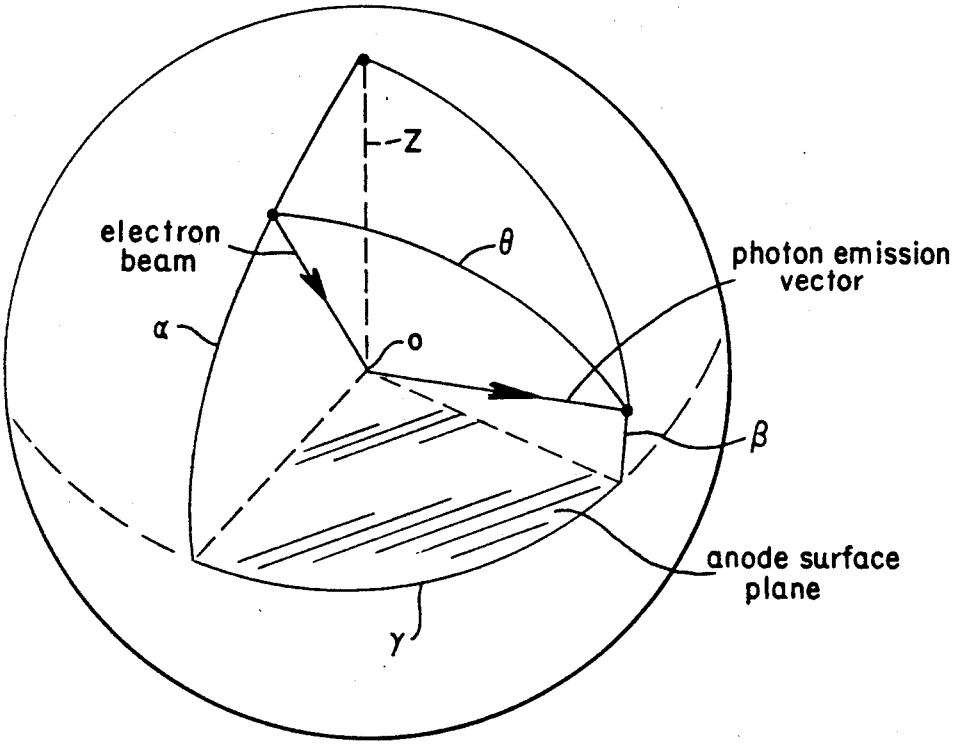
FIG. 9 is a spherical graphical representation of the glancing angles, $\alpha$, $\beta$, $\gamma$ and $\Theta$.

Since the reader may be confused by the foregoing, for purposes of clarification, the simplest relationship of angles $\alpha$, $\beta$, $\gamma$ and $\Theta$ in spherical coordinate system is now described. Referring to FIG. 9, an exaggerated representation, point 0, is located in the anode surface plane. A line is established through that point normal to the anode plane. This line is denoted as the Z-axis. If the electron beam impinges on this point 0 while establishing an angle $\alpha$ with respect to the anode plane, the angle is measured in a plane containing the Z-axis and the electron beam. In other words, the angle is defined as that between the intersection of that plane with the anode plane and the electron beam.

A similar construction is performed for the direction chosen for the x-ray beam. This defines a plane containing the Z-axis and the x-ray beam direction in intersection with the anode plane and the angle $\beta$. Now the angle between the two intersection lines in the anode plane is called $\gamma$, while the angle in a plane containing both the electron beam and the x-ray direction is called $\Theta$. The angle denoted by "emission angle" in the technical literature is the angle supplementary to $\Theta$, i.e. the angle 180°−$\Theta$. From spherical trigonometry one knows the following relation between the diverse angles:

$$\cos\Theta = \sin\alpha\sin\beta + \cos\alpha\cos\beta\cos\gamma.$$

Given the basic geometric overview, above, the salutary aspects of optimizing the emission angle (maximizing the emission probability) should be apparent. First, as in maintaining a high $\sin\alpha/\sin\beta$ ratio, the third dimensional, angle $\gamma$ allows maintenance of the emission angle $\Theta$ at a favorable value as governed by the emission probability distribution.

Secondly, the selection of a specific relationship between the anode plane, the electron source and the collimator determines the character and energy of the x-rays collected. A corollary to this concept is that the collimator and source may be positionally fixed while the anode is manipulatable in three dimensions or, alternatively, the anode may be fixed and the collimator moved. Other evident variations are not detailed here.

A third benefit contemplates optimizing selection of the most intense portion of generated x-rays containing the x-rays of desired frequency by properly locating the collimator relative to the anode to receive that selected portion of x-ray emission.

Referring briefly to the use of a rotating anode to generate a flat beam (collimated) for use in CT type systems, it is recognized that geometric constraints coupled with the lack of focusing such as with a pencil beam, prevent the use of a small emission angle $\beta$, while still permitting the use of a small angle $\alpha$ for the electron beam. In this context the properly selected angle $\gamma$ can contribute significantly to optimize high energy x-ray production and minimize anode heating. The characteristics of skewing the electron beam impingement from normal to the anode surface, allows, in part, the anode to act as its own filter. In other words, the anode scatters out the undesired low energy electrons in order to maximize output along the plane defined by the emitted fan beam for a given power density of the impinging electron beam.

Figure 10:
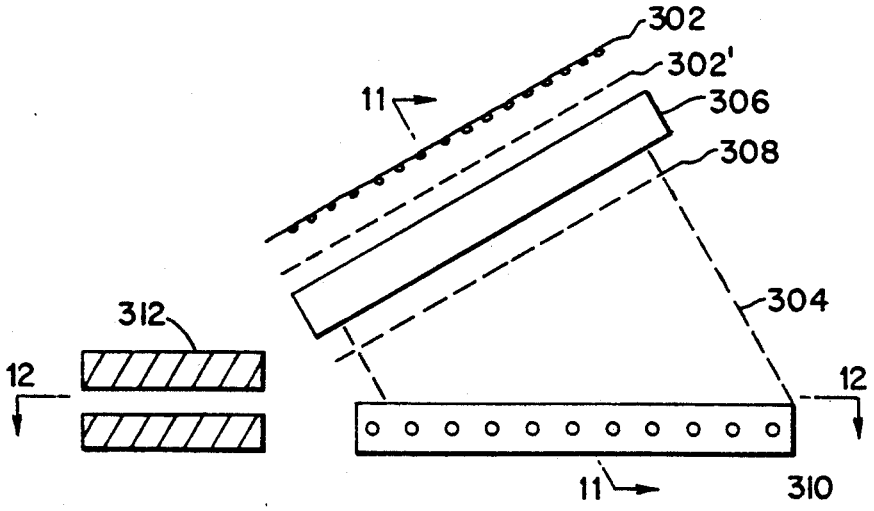
FIGS. 10–13 are views of an apparatus for producing a "wiggling" x-ray beam.
Figure 11:
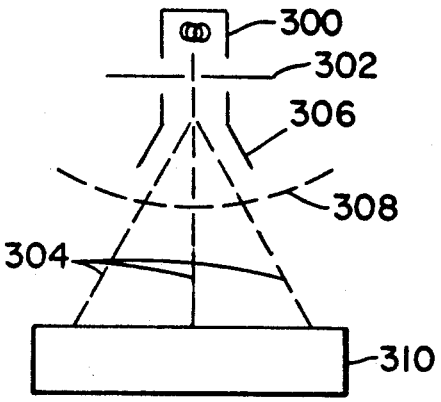

The foregoing permits design of x-ray imaging systems departing from the conventional large $\alpha$ and large $\beta$ systems. For example, a system employing a small $\alpha$ and small $\beta$ for fixed directional, pencil beams can be constructed. The beam is spread out which either increases the power density on the anode and/or increases the x-ray emission power in the desired beam direction and cross-sectional configuration. Also improved performance of a fan or broad photon emission beam can be achieved with a small $\alpha$ and large $\beta$. A third variant, a large $\alpha$ and small $\beta$, while less desirable for fixed direction pencil beams, finds utility in applications involving a wiggling or sweeping beam (see FIG. 10). In all such systems, the angle is selected to maximize emission probability which depends on the particular requirements of the user.

A modification of the pencil beam generating apparatus is a sweeping pencil beam device. It is useful, for example, for the elimination of the fogging of a transmission image arising from the secondary photons generally originating with Compton scattering of the primary photons of the x-ray beam in the object being examined.

An example of a sweeping pencil beam generating apparatus is depicted in FIGS. 10–13. Electron curtain beam 304 is generated by beam forming system (cathode 300, anode 302). This curtain beam passes through deflection electrodes 306 and post-accelerating grid 308 to activate the beam to the required kilovoltage. The beam enters the drift space and then impinges on the target anode 310 to generate the bremsstrahlung photons.

The consequence of the varying length of the post-deflection drift space (short at the beam exit end, long at the back end) is that the x-ray photons forming the pencil beam pass through waist 314 of "hour-glass" collimator 312, sweeping over an arc with fulcrum at the collimator waist 314.

In view of the fact that the electron beam is swept over the anode, it covers an area which is larger than that of the stationary pencil beam apparatus. Therefore, the electron beam current can be further increased above the value allowed for the stationary beam apparatus without exceeding the power density capacity of anode 310. Therefore, the relation between the electron beam power, and the permissible power density $D_{max}$ (cf. equation 2 above), and the desired area A of the x-ray beam is changed to $$\sin\beta \leqq \frac{AD_{max}}{P_e} \quad \frac{w}{z} \tag{4}$$

Figure 12:
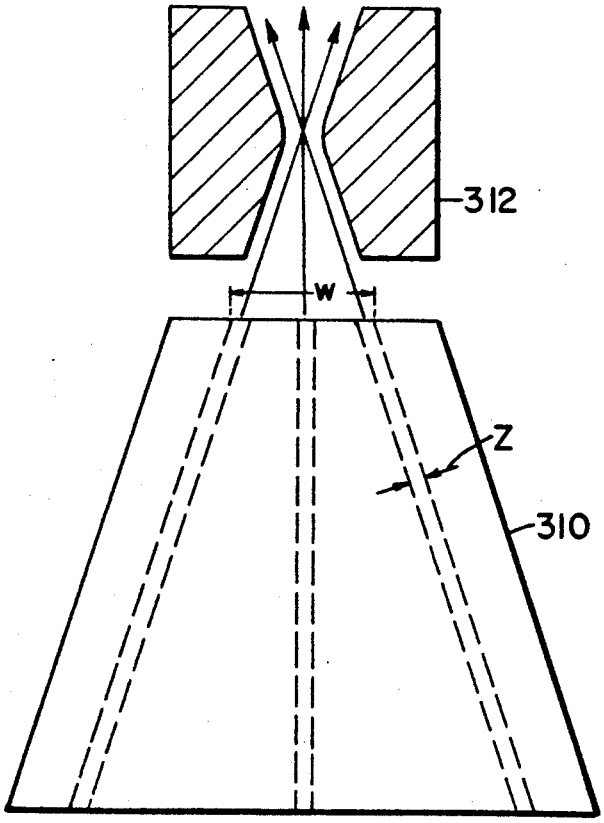

In FIG. 12, the smallest electron curtain beam sweep amplitude on the x-ray target, anode 320, is indicated as w. As in equation (2), z indicating the width of the x-ray beams, is given by that "thickness" of the electron curtain beam 304. This increased load tolerance can be utilized to increase the available x-ray beam intensity. It should now be appreciated by a person of skill in the art of rotating anode x-ray tubes that the actual power handling capability of the pencil beam sweeping apparatus will also depend on the sweep velocity, which here replaces the tangential anode velocity in the case of the rotating anode tube.

In practical terms, as mentioned earlier, it is desirable to eliminate scatter from a transmission picture. If the "read-out" (receptors) of a system, such as that described in U.S. Pat. No. 4,821,304 (incorporated herein by reference), is selectively activated (coordinated) to receive only those properly aligned x-ray emissions generated from a sweeping beam, the image fogging resulting from x-ray scatter can be largely eliminated. Thus, imaging quality is improved.

Another modification of the pencil beam apparatus is a fan beam apparatus. It would use the same x-ray anode and collimator arrangement as the sweeping pencil beam apparatus, but involves replacement of the electron curtain beam by a broad beam impinging on the full anode area 212' of FIG. 8 at all times. The geometric relation between the bremsstrahlung radiating area 212' and the photon transmitting opening 216', 218' of the collimator is illustrated in FIG. 7.

Figure 13:
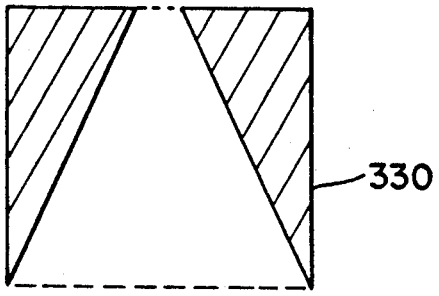

Also, the design of collimator 330 can be simplified to the form illustrated in FIG. 13.

Other improvements, modifications and embodiments will become apparent to one of ordinary skill in the art upon review of this disclosure. Such improvements, modifications and embodiments are considered to be within the scope of this invention as defined by the following claims.

I claim:

1. The method for producing from an x-ray generating apparatus, maximum x-ray emission for a specific x-ray energy range from an anode upon which an electron beam of selected power impinges, comprising the steps of:

directing the electron beam toward the x-ray producing anode at an angle $\alpha$ from about 1° to below 5° relative to the anode surface, selecting x-ray photon emission beam at angle $\beta$ relative to the anode surface, selecting an angle $\gamma$ defined by the angle between the intersection of the planes normal to the anode surface and containing the electron beam and photon emission beam, respectively, to maximize the photon emission probability for photons having a desired energy, thereby to maximize the intensity of the selected x-rays.

2. A method according to claim 1, further comprising the steps of selecting an x-ray beam emission axis for the anode defining an angle $\beta$ where the ratio of $\sin\alpha/\sin\beta$ is at least 20 and providing a collimator for forming the x-rays into a pencil beam.

3. A method according to claim 2 where the angle $\alpha$ and the photon emission direction are less than 5°.

4. A method according to claim 3 where the incident angle $\alpha$ is selected to reduce multiple scattering of electrons in the anode and to maximize deflection of low energy electrons and maximize generation of bremsstrahlun x-rays in a desired energy range.

5. Apparatus for safely producing a maximum energy in an x-ray beam for a specific range of x-ray energies above a predetermined energy level from a target volume extending a predetermined distance below the surface of an anode positioned to be struck by an electron beam, said apparatus comprising an anode having a surface disposed to be impinged upon by a beam of electrons, said target producing x-rays when struck by electrons, means for directing the beam of electrons at said surface at an angle $\alpha$, means for defining a target area for the x-rays produced by said anode lying at an angle $\beta$ relative to said surface, the value of $\beta > cs \sin \alpha$ wherein c is the density of said x-ray producing anode times the loss in the target and s is the length of travel of electrons in said anode.

6. The apparatus according to claim 5 wherein $\beta$ lies in a range of 5° and less.

7. The method for producing maximum intensity x-rays from an x-ray apparatus having an electron beam anode comprising:

defining the intensity, spectrum of intensities, divergence and width and height of the x-ray beam in accordance with use requirements, defining a collimator to determine the x-ray beam area and divergence, producing an electron beam having an energy and beam power to produce x-rays of the desired maximum energy and intensity in the electron beam anode;

locating the axis of the collimator at an angle $\beta$ to the surface of the electron beam anode such that $$\sin\beta \leqq \frac{AD_{max}}{P_e}$$

where A is the are of the anode parallel to the anode surface impacted by the electron beam, $D_{max}$ is the maximum power density tolerated by the anode without overheating, $P_e$ is the electron beam power, and establishing an angle $\alpha$ between the electron beam and the surface of the anode to determine the spectrum of photon energies in the x-ray beam.

8. An x-ray producing apparatus comprising an electron beam generating means, an electron beam anode for emitting x-rays when bombarded by electrons, a collimator having an axis for permitting x-rays generated in said anode to be directed only to a specific x-ray target area, said collimator providing a size of opening of an area determined by the use to which the x-ray beam, said anode having a surface lying at an angle of less than 5° to the axis of said collimator, said electron beam generating means directing an electron beam at an angle $\alpha$ to the x-ray beam in the approximate range of 60° to 120°, said collimator, anode and said x-ray beam being positioned to substantially maximize emission probability of photons having a desired energy, said electron beam generating means producing a beam of a size such that the kilowatts per square centimeter of dissipation in said anode lies below a maximum for the material of said anode.

9. The method for producing from an x-ray apparatus a maximum energy in an x-ray beam for a specific range of x-ray energies from an anode volume extending a predetermined distance below the surface of an anode that is struck by an electron beam, the method comprising:

aiming an electron beam at an x-ray producing anode, at an angle $\alpha$ to the surface of the anode, defining an axis for emission of the x-ray beam from the apparatus at an angle $\beta$ to the surface of the anode, the beam angle $\alpha$ of between about 1° to below 5° and the angle $\beta$ defining the ratio of $\sin \alpha / \sin \beta$ of at least 20, selecting an angle of emission probability to optimize generation of x-rays of a select energy range and intensity in said x-ray beam.

10. A method as in claim 8 including the step of: p1 setting $\beta$ to be larger than the angle at which a prescribed percentage of photons is absorbed.

11. A method as in claim 10 wherein the prescribed percentage is 30%.

12. A method as in claim 10 further comprising the step of:

selecting the angle $\alpha$ of the electron beam to reduce the effects of multiple scattering of electrons in the anode.

13. Apparatus for safely producing a maximum energy in an x-ray beam for a specific range of x-ray energies above a predetermined energy level from a target volume extending a predetermined distance below the surface of an anode positioned to be struck by an electron beam, said apparatus comprising:

an anode having a surface disposed to be impinged upon by a beam of electrons, said anode producing x-rays when struck by electrons, means directing the beam of electrons at said surface at an angle $\alpha$.

a collimator for defining a target area for the x-rays produced by said anode at an angle $\beta$ relative to said surface, said angles $\alpha$ and $\beta$ being such that the value of $\sin \alpha / \sin \beta$ lies above approximately 20.

said means for defining determines an angle $\alpha$ smaller than the angle at which 30% of photons are absorbed by the anode.

14. An apparatus according to claim 13 further comprising means for adjusting the angle $\alpha$ to control the effects of multiple scattering of electrons in said target.

* * * * *